US005874395A

United States Patent [19]

Ewbank et al.

[11] Patent Number: 5,874,395

[45] Date of Patent: Feb. 23, 1999

[54] LIQUID RINSE CYCLE FABRIC SOFTENING COMPOSITIONS CONTAINING DIACID POLYMERIC FATTY ESTER QUATERNARY AMMONIUM COMPOUNDS

[75] Inventors: Eric Ewbank, Kraainem; Dominique Tummers, Seraing, both of Belgium

[73] Assignee: Colgate-Palmolive Company, New York, N.Y.

[21] Appl. No.: 999,047

[22] Filed: Dec. 29, 1997

[51] Int. Cl.[6] ..... C11D 1/645; C11D 1/835

[52] U.S. Cl. ..... 510/475; 510/504; 510/522; 510/501

[58] Field of Search ..... 510/475, 504, 510/522, 501

[56] References Cited

U.S. PATENT DOCUMENTS

| | | | |
|---|---|---|---|
| 5,525,244 | 6/1996 | Turner et al. | 252/8.8 |
| 5,703,035 | 12/1997 | Birkhan et al. | 510/423 |
| 5,747,109 | 5/1998 | Farooq et al. | 427/242 |

*Primary Examiner*—Paul Lieberman
*Assistant Examiner*—John R. Hardee
*Attorney, Agent, or Firm*—Bernard Lieberman

[57] ABSTRACT

A stable, pourable and water dispersible fabric softener composition is described comprised of up to 35%, by weight, of (i) an amidoamine compound such as bis(tallow amidoethyl)-2-hydroxyethyl amine or an amidoquaternary ammonium compound; and (ii) a diacid polymeric fatty ester quaternary ammonium compound as described.

9 Claims, No Drawings

LIQUID RINSE CYCLE FABRIC SOFTENING COMPOSITIONS CONTAINING DIACID POLYMERIC FATTY ESTER QUATERNARY AMMONIUM COMPOUNDS

FIELD OF THE INVENTION

This invention relates to liquid fabric softening compositions. More particularly, the invention relates to liquid fabric softening compositions containing diacid ester derivatives of trialkanol-amine esterquat compounds. The compositions are primarily intended as rinse cycle fabric softening compositions suitable as ready-for-use products or as concentrates which can be used in undiluted form as ready-for-use products at reduced dosage or alternatively as products which are diluted before use with water for use at the same dosage levels as the conventional ready-for-use products.

BACKGROUND OF THE INVENTION

Compositions containing quaternary ammonium salts or imidazolinium compounds having at least one long chain hydrocarbyl group are commonly used to provide fabric softening benefits when used in a laundry rinse operation. Numerous patents have been issued for these types of compounds and compositions.

More recently, however, in view of concerns for the environmental safety (e.g., biodegradability) of the quaternary compound softeners, as well as limits in the amounts of these cationic compounds which can be stably incorporated into the more convenient to use liquid formulations, there have been many proposals for partial or total replacements of the conventional "quat" fabric softeners which are exemplified by dimethyl distearyl (or ditallow) ammonium chloride and various imidazolinium compounds.

For instance in GB 2,032,479A, corresponding to EP 038862, to D. Fontanesi (assigned to Albright & Wilson Ltd.) water dispersible unquaternized hydroxyalkyl diamidoamine compounds of formula $$RNH((CH_2)_nNR)_mR$$

wherein an average of from 20% to 80% of the R groups are $C_{12}$ to $C_{22}$ acyl, at least 20% of the R groups are $—CH_2CH_2OH$ or $—CH_2CHOHCH_3$ or mixtures of these groups, and any other R group is hydrogen, n is 2 or 3 and m is an integer of from 2 to 5, are provided as mobile pastes in the presence of lower alkanol solvents. This is stated to be in contrast to partially neutralized unquaternized diamidoamines which, while providing highly effective fabric softening properties, are too viscous even when diluted in the lower alkanol solvents for convenient handling.

U.S. Pat. No. 5,154,838 (corresponding to EP 0459211A2) to Yomamura, et al. (assigned to Kao Corp.) discloses an aqueous liquid softener composition based on an amidoamine compound which is the condensation reaction product of a di- or tri-arnine of formula (I):

$$R^1NH(C_mH_{2m}NH)_nH \qquad (I)$$

with a fatty acid of formula (II):

$$R^2\underset{\underset{O}{\|}}{C}—OH \qquad (II)$$

wherein $R^1$ represents a straight or branched chain, saturated or unsaturated hydrocarbon group having 8 to 24 carbon atoms, $R^2$ represents a straight or branched, saturated or unsaturated hydrocarbon group having 7 to 23 carbon atoms, m represents 2 or 3, and n is 1 or 2. These compounds, which are neither hydroxylated or ethoxylated, are noted to have high dispersibility in rinse water, especially when the amidoamine compound is used in the form of its neutral salt.

U.S. Pat No. 5,108,628 to Uphues, et al. (Henkel) discloses certain aliphatic carboxylic acid amidoamines which are obtained by reaction of polyamines (e.g., diethylentriamine, aminoethyl ethanolamine) with carboxylic acid mixtures containing ether carboxylic acids ($R—O—(CH_2CH_2O)_n—CH_2COOH$, $R=C_{8-18}$ alkyl, $C_{8-18}$ alkenyl or $CH_2—COOH$, n=2 to 20, in combination with aliphatic $C_{8-22}$ monocarboxylic acids and/or amide-forming aliphatic $C_{8-22}$ monocarboxylic acid derivatives) as fabric softeners stable in the presence of electrolytes.

In U.S. Pat. No. 5,133,885 to L. Contor, et al. (corresponding to EP 0423894, both assigned to Colgate-Palmolive Company, the assignee of the present invention) fabric softening compositions are described which are aqueous dispersions of a fatty acid ester quat of formula:

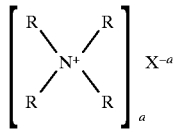

where one or two R groups represent an aliphatic ester residue of from 12 to 30 carbon atoms of formula $C_nH_{2n}OCOR_4$, and the remaining R groups represent lower aliphatic, aryl or hydroxyalkyl groups, $X^-$ is an anion and "a" represents the ionic valence of the anion, and a fatty acid amidoamine softener of formula:

$$R^1CONH(CH_2)_m\underset{\underset{R^2}{|}}{N}—R^3$$

where $R^1$ is a $C_{12}$ to $C_{30}$ alkyl or alkenyl group, $R^2$ represents $R^1$, $R^1CONH(CH_2)_m$ or $CH_2CH_2OH$; $R^3$ represents hydrogen, methyl, or $(CH_2CH_2O)_pH$, m is a number of 1 to 5 and p is a number of 1 to 5, at a weight ratio of ester quat to amidoamine of from 10:1 to 1:10. This patent discloses total amounts of esterquat and amidoamine ranging from 3% to 60% by weight, however, compositions containing at most 8% by weight of active softeners are disclosed.

U.S. Pat. No. 5,180,508 to Birkhan, et al. (corresponding to EP 0413249, assigned to Witco Surfactants GmbH) discloses aqueous fabric softener rinsing agents based upon a mixture of quaternary salt compounds: a first component (a) of formula (I)

$$[R^2)_y—\overset{\overset{(R^3)_x}{|}}{N}—(CH_2\overset{\overset{R}{|}}{C}H—OR^1)_{3-n}]_g^{m+}mA^{-g} \qquad (I)$$

wherein, each R is independently hydrogen or lower alkyl;

each $R^1$ is hydrogen or an alkylcarbonyl group containing 15–23 carbon atoms, provided that at least one of $R^1$ is an alkylcarbonyl group;

each $R^3$ is an alkyl group containing 1–4 carbon atoms which is unsubstituted or substituted with 1, 2, or 3 hydroxy groups;

each $R^2$ is an alkyl group containing 1–4 carbon atoms which may be unsubstituted or substituted with 1, 2, or 3 hydroxy groups, or is a group of the formula:

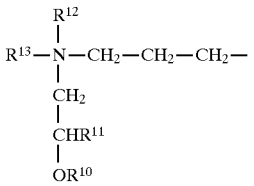

(II)

$R^{13}$ is an alkyl group containing 8–22 carbon atoms; $R^{12}$ is an alkyl group containing 1–4 carbon atoms which is unsubstituted or substituted with 1, 2, or 3 hydroxy groups;

$R^{11}$ is hydrogen or lower alkyl;

$R^{10}$ is hydrogen or alkylcarbonyl group containing 14–22 carbon atoms;

A is an anion of a quaternizing agent;

n is 0 or 1;

x and y are independently 0 or 1 with the proviso that (x+y)+(3−n)=4; and m is 1 or 2; and g is 1, 2 or 3, such that (m/g)(g)=m, and a second component (b) which is a quaternary salt of an imidazolinium compound (III), an amidoamine compound (IV), an ammonium compound (V), or diimidazolinium compound (VI). The amidoamine amine compound has the formula:

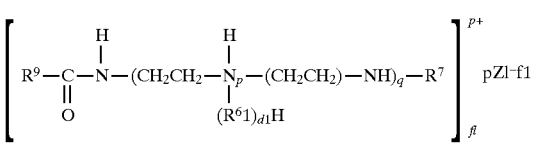

(IV)

wherein $R^6{}_1$ is CHX—CHY—O;

X and Y are independently hydrogen or lower alkyl (but not both alkyl);

$R^7$ is an alkylcarbonyl group containing 4–22 carbon atoms or H;

$R^9$ is an alkyl group containing 14–22 carbon atoms, $Z_1$ is a water-soluble monobasic or polybasic anion;

d and $d_1$ are independently 0–6; q is 0 or 1; $f_1$ is 1, 2 or 3; p is 1–3; and p+q $^3$2.

The mixture of the soft-rinsing agent (a) and (b) constitutes from 10 to 25% by weight of the composition at ratios of (a):(b) of from 1:9 to 9:1. The alkyl groups in $R^7$ and $R^9$ are preferably completely saturated. Viscosity control agents, including electrolyte salts, e.g., calcium chloride, may be included.

U.S. Pat. No. 4,724,089 to König, et al. discloses aqueous dispersions of certain amines, including reaction products of higher fatty acids with a polyamine (e.g.,

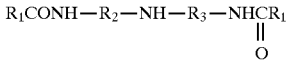

where $R_1$=acyclic aliphatic $C_{15}$–$C_{21}$ hydrocarbon; $R_2$ and $R_3$=divalent $C_1$–$C_3$ alkylene groups) with a dispersing aid (e.g., HCl) and, optionally, quaternary ammonium salt (e.g., diamido (alkoxylated) quaternary ammonium salts). Relatively small amounts of electrolyte, e.g., $CaCl_2$, can be added to adjust viscosity.

EP 0295,386 to Ruback, et al. discloses a free-flowing softening washing rinse concentrate containing (a) from 18 to 50 weight percent of a mixture of at least two quaternary ammonium salts: (A) 10–90 wt % of triethanol-amine ester quaternary ammonium compound, and (B) 90 to 10 wt % of another quaternary compound including quaterized amidoamine (or equivalent esteramine or thioamine) and (b) water and optional conventional additives.

While these and many other proposals are known for improved fabric softening compositions, nevertheless, still further improvements are desired.

One such proposal is described by Schramm, et al. in U.S. Pat. No. 5,476,598. According to this proposal stable, aqueous, pourable and water dispersible, fabric softener compositions are provided which include (A) a fabric softening effective amount of an inorganic or organic acid salt of a finely divided softening compound of formula (I):

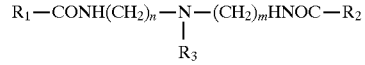

(I)

wherein $R_1$ and $R_2$, independently, represent $C_{12}$ to $C_{20}$ alkyl or alkenyl; $R_3$ represents $(CH_2CH_2O)_pH$, $CH_3$ or H; n and m are each a number of from 1 to 5; and p is a number of from 1 to 10; (B) a stabilizing amount of a defined emulsifier-dispersing agent; and (C) an aqueous solvent. The compositions are provided as ready-to-use products or as concentrates to be used at reduced levels or which may be diluted with water prior to use at the same or similar levels as the ready-to-use products. In the ready-to-use composition the total amount of amidoamine softener (A) and stabilizing dispersant (B) is disclosed to fall in the range of from about 2 to 8% by weight. In the concentrated form the total amount of (A) and (B) is generally in the range of from about 12 to 60% and may be diluted at ratios of water:concentrate as high as about 4:1 to even 8:1 or 9:1, and still provide acceptable softening performance, equivalent or better than that achieved using conventional quaternary cationic surfactant softeners, such as dimethyl distearyl ammonium chloride (DMDSAC).

An alternative embodiment of the Schramm, Jr., et al. fabric softener aqueous liquid compositions which is adaptable for use in the rinse cycle of a laundering process and which is described as stable, pourable, and dispersible in water, includes the following ingredients:

(A') an inorganic or organic acid salt of bis(hydrogenated tallow amidoethyl) hydroxyethyl amine, (B') an inorganic or organic acid salt of bis(non-hydrogenated tallow amidoethyl) hydroxyethyl amine, with the total amount of (A') and (B') being from about 2% to about 50% by weight of the composition, and the ratio by weight of (A') to (B') being in the range of from about 10:1 to abut 1.5:1, and an aqueous solvent.

The compositions disclosed in the aforesaid U.S. Pat. No. 5,476,598 to Schrarnm et al. provide highly effective stable and pourable liquid fabric softener compositions; nevertheless, in practice it is found that with concentrations of the amidoamine fabric softening compound (e.g. Varisoft 510) in excess of 11 weight percent in the presence of certain emulsifiers, such as hydrogenated tallow, the product viscosity becomes excessively high, even in the presence of electrolytes (e.g. $CaCl_2$) or solvents (e.g. propanol). While higher total concentrations of the amidoamine were achieved using the soft tallow product Varisoft 512 or mixtures of Varisoft 512 and hard tallow product, Varisoft 510, the softening performance of the Varisoft 512 containing compositions, was not sufficiently improved.

The prior art has focused attention on ways to increase the concentration in the liquid fabric softening composition of the amidoamine softener compound Varisoft 510 in view of its very good environmental attributes and favorable acute toxicity data as well as its strong softening performance. However, as noted above, at high concentrations the viscosity increases substantially until gelation occurs.

It was recently discovered that the incorporation of cyclic imidazolinium compounds can increase the concentratability of fatty amido tertiary amine softeners and also significantly improve the softening efficacy of Varisoft 510. This discovery is described in greater detail U.S. Pat. No. 5,468,398 to Farooq et al. According to this patent a stable, pourable, water dispersible aqueous liquid fabric softener composition includes:

(A) a softening effective amount of an inorganic or organic acid salt of a finely divided fatty amido tertiary amine compound of formula (I):

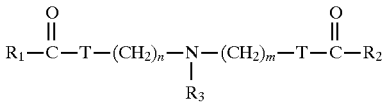

(I)

wherein $R_1$ and $R_2$, independently, represent $C_{12}$ to $C_{20}$ alkyl or alkenyl; $R_3$ represents $(CH_2CH_2O)_pH$, $CH_3$ or H; T represents O or NH; n and m are each, independently, a number of 1 to 5; and p is a number of from 1 to 10; (B) a viscosity controlling and softening improving effective amount of a defined cyclic imidazolinium compound; and (C) an aqueous solvent including an anti-gelling effective amount of electrolyte. Compositions containing up to 25 wt % of active ingredients (A) and (B) are exemplified, with amounts of (A) and (B) up to 60% being disclosed.

In an effort to provide concentrated liquid fabric softening compositions containing more than 25%, by weight, of a softening system based on amido amine and a diesterquaternary compound, there is described in U.S. Pat. No. 5,501,806 to Farooq et al. a concentrated softening composition characterized by hydrocarbon groups in the defined softening compounds which have a specified degree of unsaturation to create a stable and efficacious softening composition. The two active softening compounds in the compositions are stated to comprise from about 25% to about 50%, by weight, of the softening composition.

Notwithstanding the various improvements described in the patent literature in formulating liquid fabric softening compositions, there remains a need for alternatives to current commercial rinse cycle fabric softening compositions which offer equivalent or enhanced softening performance concomitant with improved biodegradability and lower ecotoxicity relative to present-day commercial softening compositions.

SUMMARY OF THE INVENTION

In accordance with the present invention there is provided a stable, pourable and water dispersible fabric softener composition comprising an aqueous dispersion of from about 2.5% to about 35%, by weight, of a combination of softening components (A) and (B) wherein:

(A) is (i) an inorganic or organic acid salt of an amidoamine compound of formula (I):

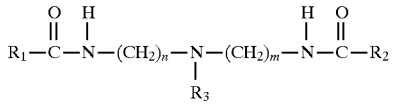

(I)

wherein $R_1$ and $R_2$ represent $C_{11}$ to $C_{29}$ aliphatic hydrocarbon groups, $R_3$ represents

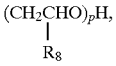

$CH_3$ or H wherein p is a number from 1 to 10 and $R_8$ is $CH_3$, $CH_2CH_3$ or H, and n and m are each, independently, a number from 1 to 5; or (ii) an amidoquaternary ammonium compound of formula (II).

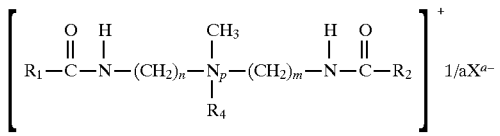

(II)

wherein $R_4$ represents

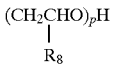

or $CH_3$; $R_1$, $R_2$, $R_8$, n and m are as defined above, and X is an inorganic or an organic anion of valence a; and (B) is a biodegradable diacid polymeric fatty ester quaternary ammonium compound of formula (III):

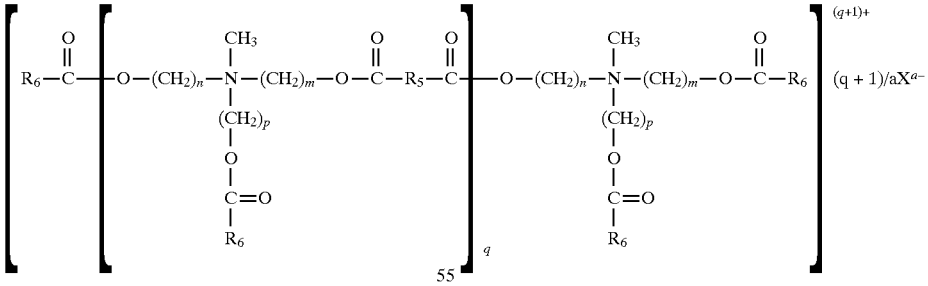

(III)

wherein $R_5$ represents a $C_1$ to $C_{18}$ aliphatic hydrocarbon group, and each $R_6$ independently represents a $C_{11}$ to $C_{29}$ aliphatic hydrocarbon group, n, m and p are each, independently, a number from 1 to 4, q is a number from 1 to 3, and X is an inorganic or organic anion of valence a; and (C) an aqueous solvent including an anti-gelling effective amount of electrolyte.

The present invention also provides a method of imparting softness to fabrics by contacting the fabrics with a softening effective amount of the invention fabric softener composition; generally and preferably, in the rinse cycle of an automatic laundry washing machine. The compositions may be diluted with water prior to adding the composition to the washing machine (e.g., the rinse cycle dispenser), or may be added, at reduced amount, without dilution, i.e., ready to use.

The level of unsaturation of the hydrocarbon groups containing two or more carbon atoms in Component (A), i.e. A(i) or A(ii), and Component (B) should be maintained above at least 15% in order to insure that the liquid fabric softening composition remains a pourable liquid, particularly, at high concentrations of active ingredients. That is, at least 15% of the hydrocarbon groups in (A) and (B) combined should contain at least one unsaturated carbon to carbon bond. In preferred embodiments, the percentage of unsaturated groups in the softening components will vary from about 20 to about 60, especially from about 20 to about 40.

The weight ratio of Component (A) to Component (B) will generally be from about 5:1 to about 1:5 in the most useful embodiments in accordance with the invention.

DETAILED DESCRIPTION AND PREFERRED EMBODIMENTS

The present invention was developed as part of an extensive research program to evaluate available fabric softening compounds which do not pose the risk of, or at least reduce the risk of, causing environmental damage associated with conventional cationic quat fabric softeners, such as dimethyl distearyl ammonium chloride (DMDSAC) yet which offer equivalent or superior softening performance to DMDSAC and which are amenable for use in concentrated products. The latter requirement is important in view of the trend in the industry to sell concentrated products which require less packaging and lower shipping costs on a per unit or per usage basis and, therefore, can be characterized as environmentally and user friendly.

As a result of this extensive research it was found that the class of amidoamines, and particularly fatty amidotertiary amines and corresponding esters of the foregoing formula (I), and which are commercially available, for example, under the Varisoft trademark from Witco Chemical Company, when provided in the form of its acid (protonated) complex, met the objectives of high efficacy softening performance and environmental acceptability. The amidoquaternary ammonium compounds of formula (II) above are suitable equivalents and are commercially available, for example, under the Accosoft trademark from Stepan Company.

Although not wishing to be bound by any particular theory of operation it is believed that the good softening performance is due to the excellent inherent dispersibility of the finely divided amidoamine softener when the compound is protonated as its acid complex. Such excellent inherent dispersibility is believed to result from the presence of the diamido amine hydrophilic group, which may be further enhanced by a moderate level of ethoxylation (e.g., when $R_3$ represents $(CH_2CH_2O)_pH$). On the other hand, the presence of the two long chain hydrocarbon groups ($C_8$–$C_{20}$ alkyl or alkenyl) contribute to effective fabric softening.

However, the concentratability of the fatty tertiary amido amine fabric softeners of formula (I) was found to be limited to no more than about 11% by weight before gelation occurs or otherwise unacceptably high viscosity results. It is presumed that this phenomenon is the result of the crystallinity of fatty tertiary amine, that is, the formation of a liquid crystalline phase. In general, the viscosity increase in concentrated samples and over time is believed to be associated with the formation of multilayered vesicle structures which trap increasing amounts of water and thereby cause the composition to exhibit an increase in viscosity. In other words, the phase volume of the composition increases with increasing softener concentration and time while the continuous (aqueous) phase gradually decreases with time.

As described in the aforementioned Schramm, Jr. et al., U.S. Pat. No. 5,476,598, it has been observed that Varisoft 512 (soft tallow tertiary amine) is capable of reducing the crystallinity of, and concentratability of Varisoft 510 (hydrogenated (hard) tallow tertiary amine) but with relatively poorer softening performance. In any case, the softening performance of the tertiary amine compound containing higher aliphatic amide or ester groups containing unsaturation (carbon to carbon double bonds), e.g., soft tallow amide, etc., is generally significantly poorer than the corresponding compounds which are fully saturated, e.g., hydrogenated tallow amide.

It had been previously reported by Farooq et al. in U.S. Pat. No. 5,501,806 that a fatty ester quaternary ammonium compound as described in the patent when added to an aqueous dispersion of the fatty amide (or ester) tertiary amine compound fabric softener of the formula (I) containing a significant level of unsaturation creates a stable, pourable, efficacious softening composition.

The mixture of the compounds of formulas (I) or (II) with (III) in accordance with the invention allow the compositions to be formulated as concentrates for subsequent dilution (if desired) at ratios as high as 8:1 or higher, while still remaining pourable in the concentrated form. These same concentrated formulas may, of course, be used without dilution but in smaller quantities to achieve superior softening performance.

Thus, the compositions of this invention are stable, pourable, and rapidly water dispersible aqueous dispersions which contain, (A) a fabric softening effective amount of an inorganic or organic acid salt of fatty amido (or ester) tertiary amine of formula (I), or amidoquaternary ammonium compound of formula (II), and (B) a synergistic fabric softening diacid polymeric fatty ester quaternary ammonium compound of formula (III), wherein the total amount of (A) and (B), combined is from about 2.5% to about 35% by weight. The aqueous dispersion which is formed within these amounts of fabric softening active ingredients is of low viscosity, namely, remains pourable at ambient temperature, particularly less than 1500 cPs at 20° C.

The fabric softening active compound (A) is an inorganic or organic acid salt of an amido tertiary amine of formula (I):

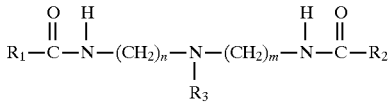

(I)

or, an amidoquaternary ammonium compound of formula (II):

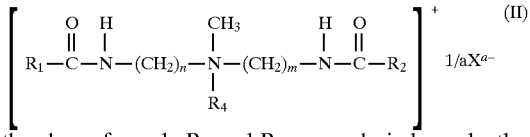

(II)

In the above formula $R_1$ and $R_2$ are each, independently, long chain aliphatic hydrocarbons, e.g., alkyl or alkenyl groups having from 11 to 29 carbon atoms, preferably from 11 to 21 carbon atoms and most preferably from 13 to 17 carbon atoms. Linear hydrocarbon groups, such as, for example, dodecyl, dodecenyl, octadecyl, octadecenyl, behenyl, eicosyl, etc., are preferred for $R_1$—CO—and $R_2$—CO—. Typically, $R_1$ and $R_2$, and more generally $R_1$—CO—and $R_2$—CO—, will be derived from natural oils containing fatty acids or fatty acid mixtures, such as coconut oil, palm oil, tallow, rape oil, and fish oil. Chemically synthesized fatty acids are also usable. Generally and preferably $R_1$ and $R_2$ are derived from the same fatty acid or fatty acid mixture. Generally, it has been discovered that when $R_1$ and $R_2$ are derived from or contain up to about 80%, but preferably not more than 65% by weight of unsaturated (i.e., alkenyl) groups, the relatively poor softening performance of unsaturated moieties of the compound of formula (I) is overcome by the combination with the polymeric ester quat compound (B) of formula (III) and an effective amount of a viscosity reducing electrolyte.

$R_3$ in formula (I) represents $$(CH_2\underset{\underset{R_8}{|}}{C}HO)_pH,\ CH_3,$$

or H, or mixtures thereof and $R_4$ represents $(CH_2CHO)_pH$ or $CH_3$ When $R_3$ and $R_4$ represent the preferred $(CH_2CH_2O)_pH$ group, p is a positive number representing the average degree of ethoxylation, and is preferably from 1 to 10, especially 1.4 to 6, and more preferably from about 1.5 to 4, and most preferably, from 1.5 to 3.0. n and m are integers of from 1 to 5, preferably 1 to 3, especially 2. The compounds of formulas (I) and (II) in which $R_3$ and $R_4$ represent the preferred $(CH_2CH_2O)_pH$ group are broadly referred to herein as ethoxylated amidoamines and ethoxylated amidoquats, respectively, and the term "hydroxyethyl" is also used to describe the $(CH_2CH_2O)_pH$ group.

Most especially preferred is the compound of formula (I) which is commercially available under the tradenames Varisoft 512 (a 90% concentration with a 10% organic solvent), or Varisoft 511 (approximately a 100% active ingredient concentration), available from Witco Chemical Company, which is bis(tallow-amidoethyl)-hydroxyethyl amine of formula $$((\text{Tallow})\text{-}\overset{\overset{O}{\|}}{C}-NH-CH_2CH_2)_2N(CH_2CH_2O)_xH \quad (X = 1.5 \text{ to } 3.0)$$

While the long chains ($R_1$ and $R_2$) of the formula (I) and formula (II) compounds may, theoretically, be entirely unsaturated, in practice the softening performance of such unsaturated compounds is not sufficient. Therefore, it is preferred to limit the amount of the unsaturated chains to no more than about 80%, preferably no more than about 65%, by weight based on the total of the $R_1$ and $R_2$ groups.

In place of a portion of Varisoft 512 or 511, there may be substituted the corresponding hydrogenated tallow amidoamine derivative, available from Witco under the tradename Varisoft 510.

Also, available from Witco Chemical is the amidoamine marketed under the tradename Rewopal V3340. It is a partly unsaturated amidoamine containing 75% hydrogenated tallow and 25% of soft tallow alkyl chains. The polyamine used for the synthesis is diethylenetriamine. The amidoamine is further alkoxylated with 2.7 molecules of ethyleneoxide. The raw material contains about 85% of actives which are solubilized in isopropanol (7.5%) and 1,2-propyleneglycol (7.5%). The structural formula is shown below:

$$R_1-\overset{\overset{O}{\|}}{C}-N-CH_2CH_2-\underset{\underset{(CH_2CH_2O)_{2.7}H}{|}}{N}-CH_2CH_2-N-\overset{\overset{O}{\|}}{C}-R_2$$

wherein $R_1$—CO—and $R_2$—CO—are partly saturated alkyl chains having the following distribution $C_{14}$(<4%); $C_{16}$ (25–35%); $C_{18}$(55–70%); $C_{20}$(<1%).

In the non-neutralized (non-protonated) form the fatty amide tertiary amine compounds are hardly or not at all dispersible in water. Therefore, in the present invention, the amine function of the amidoamine compound is at least partially neutralized by a proton contributed by a dissociable acid, which may be inorganic, e.g., HCl, $H_2SO_4$, $HNO_3$, etc. or organic, e.g. acetic acid, propionic acid, lactic acid, citric acid, glycolic acid, toluene sulfonic acid, maleic acid, fumaric acid, and the like. Mixtures of these acids may also be used, as may any other acid capable of neutralizing the amine function. The acid neutralized compound is believed to form a reversible complex, that is, the bond between the amine function and proton will disappear under alkaline pH conditions. This is in contrast to quaternization, e.g., with a methyl group, wherein the quaternizing group is covalently bonded to the positively charged amine nitrogen and is essentially pH independent.

The amount of acid used will depend on the "strength" of the acid; strong acids such as HCl, and $H_2SO_4$ completely dissociate in water, and, therefore, provide a high amount of free protons ($H^+$), while weaker acids, such as citric acid, glycolic acid, lactic acid, and other organic acids, do not dissociate completely and, therefore, require a higher concentration to achieve the same neutralizing effect. Generally, however, the amount of acid required to achieve complete protonation of the amine, will be achieved when the pH of the composition is rendered strongly acidic, namely between about 1.5 and 4. HCl and glycolic acid are preferred, and HCl is especially preferred.

Furthermore, the amount of acid used for neutralization should be sufficient to provide at least an 0.5:1 molar ratio, and up to about a 1:1 molar ratio of the acid to the total amount of fabric softener fatty amide tertiary amine. For the organic carboxylic acids, however, it is preferred to use a molar excess of the neutralizing acid. Molar ratios of organic carboxylic acid to the compound of formula (I) up to about 6:1, for example from 1.5:1 to 6:1, such as 2:1, 3:1 or 4:1, have been found advantageous in terms of stability and/or softening performance. The use of glycolic in molar excess is especially preferred.

However, it has also been found that partially neutralized ethoxylated fatty amide tertiary amines are highly stable. Therefore, in some cases molar ratios of acid (as HCl) to ethoxylated amine of formula (I) of from 0.5:1 to about 0.95:1, such as 0.6:1 and 0.7:1, can be advantageously used. For the mineral acids, such as HCl, molar ratios above 1:1 should generally be avoided since, otherwise, a destabilization (phase separation) may occur.

Amidoquaternary ammonium compounds are commercially available from Stepan Company under the trademark Accosoft. Accosoft 440-75, a preferred amidoquat compound, is a fully saturated amidoquat based on hard tallow alkyl chains. It is alkoxylated with 2.5 moles of ethylene oxide. Other suitable amidoquat compounds based on tallow are available in the Accosoft series, and an Accosoft 750 based on Soya is also useful herein.

The second essential fabric softener compound according to this invention is the biodegradable diacid fatty ester quaternized ammonium compound (B) of the following formula (III):

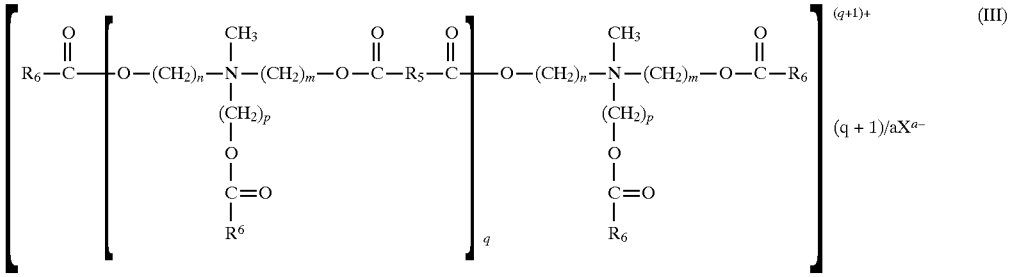

(III)

$R_5$ represents a $C_1$ to $C_{18}$ aliphatic hydrocarbon group, and each $R_6$ independently represents an aliphatic hydrocarbon group having from 11 to 29 carbon atoms , preferably from 11 to 21 carbon atoms, and most preferably 13 to 17 carbon atoms. $R_5$ is generally a saturated, partly saturated or hydroxy substituted hydrocarbon group. Typical diacyl-$R_5$ or CO—$R_5$—CO diacids are malonic acid, malic acid, succinic acid, maleic acid, glutaric acid, adipic acid, 1,12-dodecanoic acid, 1,14-tetradecandioic acid, 1,16-hexadecandioic acid, 1,18-octadecandioic acid, and the like. $R_6$ is advantageously derived from hard or soft tallow, coco, stearyl, oleyl, and the like.

n, m, and p, each, independently, represent a number from 1 to 4, and q represents a number from 1 to 3.

X represents a counter ion of valence a such as $Cl^-$, $Br^-$, $I^-$, $CH_3OSO_3^-$, $CH_3CH_2OSO_3^-$, $(CH_3O)_2PO_2^-$ and the like.

The polymeric esterquat diacid derivatives of formula (III) are commercially available from Kao under names such as Tetranyl PH-5 and Tetranyl PH-2. These compounds are obtained through the esterification of triethanolamine with a mixture of fatty acyl groups, preferably from tallow, and dicarboxylic acids, preferably such as adipic acid. Esters are further quaternized with $Me_2SO_4$. The addition of dicarboxylic acid into the esterification mixture results in the formation of dimeric and/or trimeric esterquats of formula (III).

The compounds (A) of formula (I) or (II) and compounds (B) of formula (III) are used in admixture, preferably at ratios of about 5:1 to about 1:5, more preferably from 2:1 to 1:2, whereby both softening performance and stability and pourability are improved. The total amounts of components (A) and (B) is from about 2.5 to about 35 wt. percent, preferably from about 3 to about 30 wt %.

The compositions of this invention are provided as aqueous dispersions in which the fabric softener compounds of formulas (I), (II) and (III) are present in finely divided form stably dispersed in the aqueous phase. Generally, particle sizes of the dispersed particles of less than about 25 microns ($\mu$m), preferably less than 20 $\mu$m, especially preferably no more than 10 $\mu$m, on average are acceptable for both softening and stability insofar as the particle sizes can be maintained during actual use, typically in the rinse cycle of an automatic laundry washing machine. The lower limit is not particularly critical but from a practical manufacturing standpoint will not generally be below about 0.01 $\mu$m, preferably at least about 0.05 $\mu$m. A preferred particle size range of the dispersed softener ingredients is from about 0.1 to about 8 $\mu$m.

The aqueous phase of the dispersion is primarily water, usually deionized or distilled water. Small amounts (e.g. up to about 5% by weight) of co-solvent may be present for adjustment of viscosity. Typically, as the co-solvent lower mono- and poly-hydroxy alcohols and aqueous will be used, generally in amounts up to about 8% by weight of the composition. The preferred alcohols and aqueous are those having from 2 to 4 carbon atoms, such as, for example, ethanol, propanol, isopropanol, and propylene glycol or ethylene glycol. Isopropyl alcohol (2-propanol) is especially preferred. However, co-solvents are not required and are generally avoided.

The compositions of this invention include an electrolyte to reduce dispersion viscosity. Generally, any of the alkaline metals or alkaline earth metal salts of the mineral acids can be used as electrolyte. In view of availability, solubility and low toxicity, NaCl, $CaCl_2$, $MgCl_2$ and $MgSO_4$ and similar salts of alkaline and alkaline earth metals are preferred, and $CaCl_2$ is especially preferred. The amount of the electrolyte will be selected to assure that the composition does not form a gel. Generally, amounts of electrolyte salt of from about 0.05 to 2.0 wt %, preferably 0.1 to 1.5 wt %, especially preferably 0.25 to 1.4 wt %, will effectively prevent gelation from occurring.

As is generally understood, the role of the electrolyte to inhibit gelation can be explained based on the assumption that the invention dispersions of the cationic softening compounds have a vesicular structure. The spacing of the multilayered vesicles in the liquid crystalline phases varies with the electrolyte concentration since it depends on the repulsion between the head groups in adjacent layers. The amount of the enclosed water tends to be reduced at high salt concentrations, causing a lowering of the disperse phase volume and the viscosity. However, if one exceeds a critical concentration of the electrolyte, this may lead to a destabilization of the emulsions by flocculation or coalescence. The phenomenon of flocculation or coalescence can be explained by considering the electrostatic stabilization of colloidal dispersions. Attractive as well as repulsive forces act on the individual particles of a dispersion. The repulsive forces increase exponentially as the particles approach each other, such as when the concentration of dispersion increases, and they become very strong when the electrical double layers (the counterions in the dispersion medium give rise to the electrical double layers that surround the colloidal particles) that envelope each particle overlap. The thickness of the electrical double layers is very sensitive to the ionic strength of the dispersion medium. Increasing the ionic strength significantly diminishes the thickness of the double layer. The repulsive forces then become of insufficient magnitude and are no longer able to overcome the attractive van der Waals forces which may lead to dispersion flocculation or coagulation.

The compositions of the invention also contain a fatty alcohol ethoxylate nonionic surfactant to emulsify the perfume present in the composition. The presence of an emulsifier is required in accordance with the invention to insure the physical stability of the composition which would otherwise be destabilized by the presence of perfume or fragrance in the composition. The fatty alcohol ethoxylates useful in the invention correspond to ethylene oxide condensation products of higher fatty alcohols, with the higher fatty alcohol being of from about 9 to 15 carbon atoms and the number of ethylene oxide groups per mole being from about 5 to 30. In the preferred fatty alcohol ethoxylates for use herein, the alkyl chain length ranges from about 13 to 15 carbon atoms and the number of ethylene groups ranges from about 15 to 20 per mole. Especially preferred for use herein is Synperonic A20 manufactured by ICI Chemicals, such nonionic surfactant being an ethoxylated $C_{13}$–$C_{15}$ fatty alcohol with 20 moles of ethylene oxide per mole of alcohol.

In general, the HLB of the nonionic fatty alcohol ethoxylates are from about 12 to 20, with an HLB range of from about 14 to 16 being preferred. They are used in the composition in sufficient amount to provide emulsification, typically from about 1 to 5%, by weight of the composition.

As used herein, the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes), the essential oils themselves being volatile odoriferous compounds and also serving to dissovle the other components of the perfume.

In the present invention, the particular composition of the perfume is of no importance with regard to the performance of the liquid fabric softener composition so long as it meets the criteria of water immiscibility and having a pleasing odor.

The compositions of the invention may contain a rheology modifier to help reduce or eliminate variations in the aqueous dispersion viscosity over time. It should be understood, however, that so long as the viscosity does not increase to an unacceptably high level over the expected life of the product (including transportation from the manufacturing plant to the market place, shelf-life in the market place, and duration of consumption by the end user) a second rheology modifier is not necessary. For example, the viscosity after, for instance, 8 to 10 weeks, should preferably not exceed about 1500 cPs (at 25° C.), especially preferably the viscosity should not exceed about 1500 cPs (at 25° C.) over the expected lifetime of the product. In many cases, initial viscosities of up to about 1,200 cPs can be achieved and maintained.

To prevent gelation of super-concentrated liquid compositions, the compositions may contain a polyethylene glycol polymer or polyethylene glycol alkyl ether polymer. The polyethylene glycol polymers useful herein have a molecular weight of at least 200 up to a molecular weight of about 8,000. Useful polymers include the polyethylene glycol and polyethylene glycol methyl ether polymers marketed by Aldrich Chemical Company. Useful amounts of polymer in the composition range from about 0.1% to about 5%, by weight. A range of from about 0.5 to about 1.5%, by weight, is preferred.

Another additive which has been found to be useful as a rheology modifier is citric acid, generally in amounts of from about 0.05 to 1.0 wt %, preferably from about 0.1 to 0.6 weight percent. Non-ionic surfactants may also be included in minor amounts (e.g. up to about 5% by weight, preferably up to about 2% by weight) as viscosity modifiers and/or emulsifying agents.

Examples of optional rheology modifiers and thickeners for use herein are well known in the art and may be chosen from, for example, polymeric rheology modifiers and inorganic rheology modifiers. Examples of the former type include polyquaternium compounds, such as Polyquaternium-24 (a hydrophobically modified polymeric quaternary ammonium salt hydroxyethyl-cellulose, available from Amercho, Inc.); cationic polymers such as copolymers of acrylamide and quaternary ammonium acrylate; the Carbopols, and the like. Generally, only minor amounts, up to about 1.0%, preferably up to about 0.8%, such as, for example, 0.01 to 0.60 percent, by weight, provide acceptable viscosity levels over time.

A useful optional ingredient often added to fabric softening compositions is a cosoftener. Among the preferred cosoftener ingredients from the compositions of the present invention are fatty alcohols, glycerol monostearate (GMS) and glycerol monooleate (GMO).

Other optional components commonly used in fabric softening compositions may be added in minor amounts to enhance either the appearance or performance properties of the liquid fabric softener compositions of this invention. Typical components of this type include, but are not limited to colorants, e.g., dyes or pigments, bluing agents, preservatives, germicides, and perfumes.

The subject liquid fabric softener compositions may be prepared by adding the active ingredients, usually as a melt, to the heated aqueous phase to which the acid component has been pre-mixed, under mixing. Low-shear mixing is generally sufficient to adequately and uniformly disperse the active ingredients in an throughout the aqueous phase. Further particles size reduction can be obtained by subjecting the composition to further treatment such as in a colloid mill or by high pressure homogenization, however, as previously noted, no significant improvement in softening performance has been associated with such particle size reduction.

The final product, whether in concentrated or diluted form must be easily pourable by the end user. Generally, therefore, final product viscosity (for a freshly prepared sample) should not exceed about 1500 centipoise, preferably not more than 1000 centipoise, but should not be too low, for example not less than about 50 centipoise. The preferred viscosity for the invention concentrated product is in the range of 120 to 1000 centipoise. As used herein, unless otherwise specified, viscosity is measured at 25° C. (22°–26° C.) using a Brookfield RVTD Digital Viscometer with Spindle #2 at 50 rpm.

The concentrated compositions may be diluted by a factor of generally 4:1 or more, preferably up to about 8:1 or even 10:1. Concentrated products with up to about 35 weight percent of softeners may be prepared and will remain pourable and stable against phase separation or suspended particle agglomeration for extended periods of time. The concentrated products of this invention provide equivalent softness at the same use level (e.g., about 110 ml for standard washing machine) as a (hypothetical) softener product containing up to about 50 weight percent or more of ditallow dimethyl ammonium chloride (DTDMAC.). For example, a composition with about 28% of softeners can be diluted to about 5% actives to provide equivalent or superior softening performance to a product containing about 7% of DTDMAC. After dilution, or for a ready-to-use product, the composition will normally contain sufficient softener to be effective when added to the rinse water in an amount of about one-eighth to three-quarters of a cup (1 to 6 ounces) providing about 50 ppm to about 250 ppm of softener in the rinse water.

EXAMPLE 1

This example evaluates the softening performance of an amidoamine/polymeric-esterquat softener composition of the invention versus a conventional ditallow dimethyl quaternary ammonium softening composition.

Softening compositions 1–8 as shown in Table 1 below were prepared containing varying amounts of active softening ingredients (A) and (B), the total actives ranging from 3.5%, by weight (composition 1) to about 28%, by weight (composition 8). The following procedure was used to prepare these compositions.

Rewopal V3340 and Tetranyl PH5 (in the amounts shown in Table 1) were each melted, mixed together with stirring and maintained at 70° C. Perfume was added to the molten mixture just prior to emulsification with the aqueous phase. Separately, HCl (in the amounts shown in Table 1) was added to heated (70° C.) deionized water. The mixture of molten softening active compounds was added to the acidified water phase with stirring using a 4-pitched-blade impeller. During addition of the molten mixture the stirring speed was increased from 300 to 700 rpm as the emulsion thickened. Calcium chloride (0.4%, as 20% aqueous solution) was added to break or prevent gelation. The hot mixture was stirred for an additional 10 minutes at 350 rpm and the emulsion was allowed to cool to 30° C. at which time colorant (0.03%) and preservative (0.01%) were added. Milliken Liquitint Royal Blue was used as colorant and KKM446 was used as preservative.

Each of the compositions was measured for initial viscosity, viscosity after storage at room temperature (RT) for 2 weeks and after 6 weeks and its softening performance.

The viscosity was measured with a Brookfield Viscosimeter Model DVII operating at 50 rpm. Spindle No. 2 was used for viscosities below 800 cps, and spindle No. 3 for viscosities between 800 and 2,000 cps.

Softening performance was evaluated versus a conventional softening composition equivalent to a 5% dispersion of ditallow dimethyl ammonium chloride (DTDMAC.). The softening efficacy of a 5% DTDMAC dispersion is referred to as 5 EQ and at double dosage level (corresponding to a 10% level of DTDMAC), the softness is referred to as 10 EQ. In the range of 1% and above and up to about 10% of DTDMAC, the softness increases linearly with dosage. Above these levels the softness no longer increases linearly with concentration and levels off. This means for a dispersion of DTDMAC at 15%, and at 12% dosage levels one cannot make a distinction in softening performance. In order to be able to refer to the linear portion of the EQ scale, the softness of concentrated products is assessed after a dilution with water sufficient to reduce the level of softening active to within the level at which a corresponding DTDMAC dispersion would be within the linear portion of the EQ scale, typically, from about 1% up to about 8%, by weight. The softening performance of the diluted composition is then measured by comparison to the benchmark softness provided by DTDMAC reference disperions. The final softening performance is then calculated multiplying the performance of the diluted product by the dilution factor.

TABLE 1

Viscosity and Softening Performance for Amidoamine/Polymeric Esterquat Compositions

| | Regular FS | | | Concentrated FS | | | | |
|---|---|---|---|---|---|---|---|---|
| Composition | 1 (%-wt) | 2 (%-wt) | 3 (%-wt) | 4 (%-wt) | 5 (%-wt) | 6 (%-wt) | 7 (%-wt) | 8 (%-wt) |
| Amidoamine (Rewopal V3340-85% AI)[1] | 2.57 | 2.83 | 3.10 | 10.29 | 16.47 | 14.35 | 18.12 | 20.60 |
| Polymeric-Esterquat (Tetranyl PH5-90% AI) | 1.45 | 1.60 | 1.75 | 5.82 | 9.33 | 11.33 | 7.77 | 11.61 |
| Perfume | 0.32 | 0.32 | 0.32 | 1.28 | 2.00 | 2.00 | 2.00 | 2.56 |
| HCl (25%) | 0.32 | 0.35 | 0.39 | 1.80 | 2.92 | 2.55 | 3.21 | 3.60 |
| CaCl2 (20%-solution) | — | — | — | 0.50 | 1.5 | 1.5 | 1.5 | 4.5 |
| Thickener[2] | — | 0.3 | 0.3 | — | — | — | — | — |
| Colorant | 0.004 | 0.004 | 0.004 | 0.014 | 0.016 | 0.016 | 0.016 | 0.022 |
| Lactic/lactate solution (80%) | 0.063 | 0.063 | 0.063 | 0.16 | 0.25 | 0.25 | 0.25 | 0.31 |
| DI-Water | Balance | Balance | Balance | Balance | Balance | Balance | Balance | Balance |
| Characteristics | | | | | | | | |
| Total actives (%) | 3.5 | 3.85 | 4.20 | 13.98 | 22.40 | 22.40 | 22.40 | 27.96 |
| AA/Polym-EstQ ratio | 1.67 | 1.67 | 1.67 | 1.67 | 1.67 | 1.2 | 2.2 | 1.67 |
| Viscosity-after making (cPs) | 18 | 160 | 1.63 | 44 | 57 | 55 | 93 | 153 |
| Softness (EQ) Ref: 5%-DTDMAC = 5EQ) | 3.5 | 4.0 | 5.0 | 14.0 | 22.0 | 22.0 | 22.0 | 24.0 |

[1]Rewopal V3340 is a commercial amidoamine compound marketed by Witco characterized by alkyl chains which are 75% hydrogenated tallow and 25% soft tallow.
[2]The thickener was BP-7050 polymer from BP Chemicals Ltd. United Kingdom.

As noted in Table 1 above, Composition 3 containing 4.2% total actives provided a degree of softness equivalent to the reference 5% DTDMAC composition. Accordingly, on a weight basis, the composition of the invention is judged to be a superior softener relative to the conventional DTDMAC softening system.

As noted from Compositions 5–7, varying the ratio of amidoamine to polymeric esterquat from 1.2 to 2.2 for the same level of total actives, had no measurable effect on the resulting softening performance.

EXAMPLE 2

The stability and viscosity upon aging of several different compositions of the invention were measured at room temperature over a period of six weeks, and the results noted in Table 2 below.

Compositions 2, 3, 4, 5, 6 and 7 are the identical compositions described in Table 1. Composition 9 is newly described.

TABLE 2

Stability and Viscosity Upon Aging for Amidoamine/Polymeric Esterquat Compositions

| | Regular FS | | Concentrated FS | | | | |
|---|---|---|---|---|---|---|---|
| Composition | 2 (%-wt) | 3 (%-wt) | 4 (%-wt) | 9 (%-wt) | 5 (%-wt) | 6 (%-wt) | 7 (%-wt) |
| Amidoamine Rewopal V3340-85% AI) | 2.83 | 3.10 | 10.29 | 14.42 | 16.47 | 14.35 | 18.12 |
| Polymeric-Esterquat (Tetranyl PH5-90% AI) | 1.60 | 1.75 | 5.82 | 8.16 | 9.33 | 11.33 | 7.77 |
| Perfume | 0.32 | 0.32 | 1.28 | 1.80 | 2.00 | 2.00 | 2.00 |
| HCl (25%) | 0.35 | 0.39 | 1.80 | 0.40 | 2.92 | 2.55 | 3.21 |
| CaCl2 (20%-solution) | — | — | 0.50 | 1.0 | 1.5 | 1.5 | 1.5 |
| Thickener | 0.3 | 0.3 | — | — | — | — | — |
| Colorant | 0.004 | 0.004 | 0.014 | 0.016 | 0.016 | 0.016 | 0.016 |
| Lactic/lactate solution (80%) | 0.063 | 0.063 | 0.16 | 0.20 | 0.25 | 0.25 | 0.25 |
| DI-Water | Balance | Balance | Balance | Balance | Balance | Balance | Balance |
| Characteristics | | | | | | | |
| Total actives (%) | 3.85 | 4.20 | 13.98 | 19.60 | 22.40 | 22.40 | 22.40 |
| AA/Polym-EstQ ratio | 1.67 | 1.67 | 1.67 | 1.67 | 1.67 | 1.20 | 2.20 |
| Stability after 6 weeks | ok | ok | ok | ok | ok | ok | ok |
| Viscosity (cPs) | | | | | | | |
| After making | 160 | 163 | 44 | 56 | 57 | 55 | 93 |
| 2 weeks @ RT | 170 | 176 | 33 | 43 | 52 | 64 | 145 |
| 6 weeks @ RT | 174 | 180 | 30 | 42 | 60 | 167 | 210 |

All compositions shown in the Table remained stable over the measured period of six weeks aging. The viscosity was almost invariant over the six week period for essentially all the compositions tested except for the concentrated compositions having an actives content of about 22% where the viscosity gradually increased over a six week period but not to the point where stability of the composition became problematical.

What is claimed is:

1. A stable, pourable and water dispersible fabric softener composition comprising an aqueous dispersion of from about 2.5% to about 35%, by weight, of a combination of softening components (A) and (B) wherein:

(A) is (i) an inorganic or organic acid salt of an amidoamine compound of formula (I):

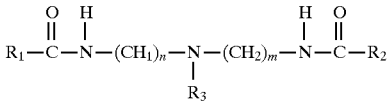

(I)

wherein $R_1$ and $R_2$ represent $C_{11}$ to $C_{29}$ aliphatic hydrocarbon groups, $R_3$ represents

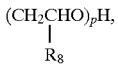

$CH_3$ or H wherein p is a number from 1 to 10 and $R_8$ is $CH_3$, $CH_2CH_3$ or H, and n and m are each, independently, a number from 1 to 5; or (ii) an amidoquaternary ammonium compound of formula (II):

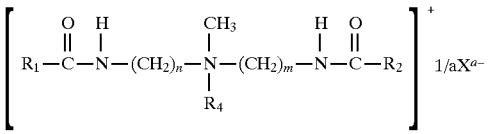

(II)

wherein $R_4$ represents

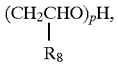

or $CH_3$; $R_1$, $R_2$, $R_8$, n and m are as defined above, and X is an inorganic or an organic anion of valence a; and (B) is a biodegradable diacid polymeric fatty ester quaternary ammonium compound of formula (III):

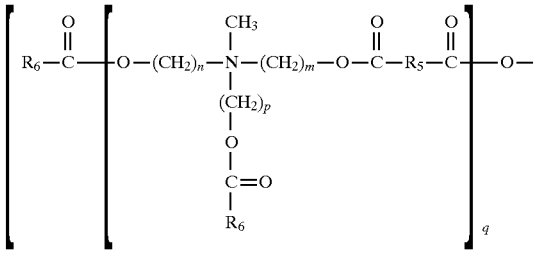

(III)

-continued

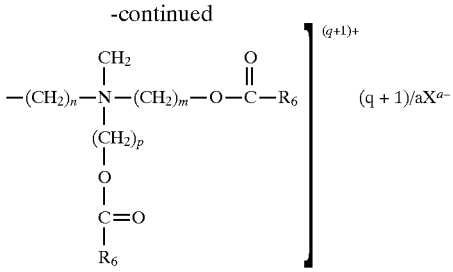

wherein $R_5$ represents a $C_1$ to $C_{18}$ aliphatic hydrocarbon group, and each $R_6$ independently represents a $C_{11}$ to $C_{29}$ aliphatic hydrocarbon group, n, m and p are each, independently, a number from 1 to 4, q is a number from 1 to 3, and X is an inorganic or organic anion of valence a; and (C) an aqueous solvent including an anti-gelling effective amount of electrolyte.

2. The composition of claim 1 wherein in the compounds of formula (I) and formula (II), $R_1$ and $R_2$ are each independently $C_{11}$ to $C_{21}$ alkyl or alkenyl; m and n are integers from 1 to 3; and $R_3$ represents $(CH_2CH_2O)_pH$ wherein p is from 1.5 to 3.0.

3. The composition of claim 1 wherein at least 20% of hydrocarbon groups containing two or more carbon atoms in components (A) and (B) combined contain at least one unsaturated bond.

4. The composition of claim 3 wherein less than 70% of said hydrocarbon groups are unsaturated.

5. The composition of claim 1 wherein the total amount of components (A) and (B) is from about 3% to about 30%, by weight, of the total composition.

6. The composition of claim 1 wherein the weight ratio of (A):(B) is from about 2:1 to about 1:2.

7. The composition of claim 1 wherein the aqueous solvent comprises water and from about 0.05% up to about 2.0%, by weight, of an alkali metal or alkaline earth metal salt electrolyte.

8. A method of imparting softness to fabrics comprising contacting the fabrics with an effective amount of the fabric softener composition of claim 1.

9. The method of claim 8 wherein said fabrics are contacted during the rinse cycle of an automatic laundry washing machine.

* * * * *